US009548157B2

(12) United States Patent
Iwasaki et al.

(10) Patent No.: US 9,548,157 B2
(45) Date of Patent: Jan. 17, 2017

(54) SINTERED MAGNET, MOTOR, AUTOMOBILE, AND METHOD FOR PRODUCING SINTERED MAGNET

(75) Inventors: Makoto Iwasaki, Chuo-ku (JP); Ryota Kunieda, Chuo-ku (JP); Fumitaka Baba, Chuo-ku (JP); Satoshi Tanaka, Chuo-ku (JP); Yoshinori Fujikawa, Chuo-ku (JP)

(73) Assignee: TDK CORPORATION, Tokyo (JP)

( * ) Notice: Subject to any disclaimer, the term of this patent is extended or adjusted under 35 U.S.C. 154(b) by 1076 days.

(21) Appl. No.: 13/384,896

(22) PCT Filed: Mar. 29, 2011

(86) PCT No.: PCT/JP2011/057878

§ 371 (c)(1),
(2), (4) Date: Mar. 2, 2012

(87) PCT Pub. No.: WO2011/122638

PCT Pub. Date: Oct. 6, 2011

(65) Prior Publication Data

US 2013/0009503 A1 Jan. 10, 2013

(30) Foreign Application Priority Data

Mar. 30, 2010 (JP) ..... P2010-079052
Mar. 30, 2010 (JP) ..... P2010-079066

(51) Int. Cl.
*H01F 41/00* (2006.01)
*H01F 41/02* (2006.01)
(Continued)

(52) U.S. Cl.
CPC ..... *H01F 41/0293* (2013.01); *C21D 6/00* (2013.01); *C22C 38/002* (2013.01);
(Continued)

(58) Field of Classification Search
CPC H01F 41/0293; H01F 41/0266; H01F 1/0577; B22F 1/0014; C22C 33/0278; C22C 38/001; C22C 38/002; C22C 38/16; C22C 38/06; C22C 2002/02
(Continued)

(56) References Cited

U.S. PATENT DOCUMENTS 6,468,365 B1 * 10/2002 Uchida ..... H01F 1/0577 148/302
7,488,393 B2 2/2009 Nakamura et al.
(Continued)

FOREIGN PATENT DOCUMENTS

CN 101447269 6/2009
JP S62-124255 6/1987
(Continued)

OTHER PUBLICATIONS

JP 2005285860 A and JP 11066533 A machine translation Sep. 30, 2014.*

*Primary Examiner* — Joshua Benitez-Rosario
*Assistant Examiner* — Leda Pham
(74) *Attorney, Agent, or Firm* — Drinker Biddle & Reath LLP

(57) ABSTRACT

The present invention provides a sintered magnet having superior residual magnetic flux density and coercive force. The sintered magnet of the present invention comprises a group of R-T-B based rare earth magnet crystal particles 2 having a core 4 and a shell 6 covering the core 4, the mass ratio of a heavy rare earth element in the shell 6 is higher than the mass ratio of a heavy rare earth element in the core 4, and the thickest part of the shell 6 in the crystal particles 2 faces a grain boundary triple junction 1. A lattice defect 3 is formed between the core 4 and the shell 6.

26 Claims, 7 Drawing Sheets

(51) Int. Cl.

| | |
|---|---|
| ***C21D 6/00*** | (2006.01) |
| ***C22C 38/00*** | (2006.01) |
| ***C22C 38/06*** | (2006.01) |
| ***C22C 38/10*** | (2006.01) |
| ***C22C 38/14*** | (2006.01) |
| ***C22C 38/16*** | (2006.01) |
| ***H01F 7/02*** | (2006.01) |
| *H01F 1/057* | (2006.01) |

(52) U.S. Cl.
CPC ..... *C22C 38/005* (2013.01); *C22C 38/06* (2013.01); *C22C 38/10* (2013.01); *C22C 38/14* (2013.01); *C22C 38/16* (2013.01); *H01F 7/02* (2013.01); *B22F 2207/01* (2013.01); *H01F 1/0577* (2013.01)

(58) Field of Classification Search
USPC ..... 310/44, 43; 148/622; 420/83
See application file for complete search history.

(56) References Cited

U.S. PATENT DOCUMENTS

2001/0021095 A1* 9/2001 Mizuno ..... C01G 23/006 361/311
2004/0050454 A1* 3/2004 Sekino ..... H01F 1/058 148/105
2006/0292395 A1* 12/2006 Mori ..... C22C 38/005 428/692.1
2008/0286595 A1 11/2008 Yoshimura et al.
2009/0019969 A1 1/2009 Kato et al.
2009/0081071 A1* 3/2009 Yamamoto ..... B22F 9/007 420/83
2009/0230382 A1* 9/2009 Banin ..... B82Y 20/00 257/14
2009/0322459 A1* 12/2009 Nagata ..... C23C 14/18 335/302

FOREIGN PATENT DOCUMENTS

| | | | | |
|---|---|---|---|---|
| JP | 6-163226 | | 6/1994 | |
| JP | 11066533 | A * | 3/1999 | ..... H01F 41/02 |
| JP | 2005-175138 | | 6/2005 | |
| JP | 2005-285860 | | 10/2005 | |
| JP | 2005285860 | A * | 10/2005 | |
| JP | 2006-210450 | | 8/2006 | |
| JP | 2006-303433 | | 11/2006 | |
| JP | 2007-329250 | | 12/2007 | |
| JP | 2009-124150 | | 6/2009 | |
| JP | 2009-254092 | | 10/2009 | |
| WO | 2005/001856 | | 1/2005 | |
| WO | 2006/043348 | | 4/2006 | |
| WO | 2006/098204 | | 9/2006 | |
| WO | 2007/088718 | | 8/2007 | |
| WO | 2008/120784 | | 10/2008 | |
| WO | 2009/004794 | | 1/2009 | |
| WO | 2009/016815 | | 2/2009 | |

* cited by examiner (a)

(b)

(c)

(a)

(b)

(c)

(a)

(b)

(c)

(a)

(b)

(c)

SINTERED MAGNET, MOTOR, AUTOMOBILE, AND METHOD FOR PRODUCING SINTERED MAGNET

TECHNICAL FIELD

The present invention relates to a sintered magnet, a motor, an automobile and a method for producing a sintered magnet.

BACKGROUND ART

R-T-B based rare earth magnets containing a rare earth element R, a transition metal element T such as Fe or Co and boron B have superior magnetic properties. Numerous studies have conventionally been carried out in order to improve the residual magnetic flux density (Br) and coercive force (HcJ) of R-T-B based rare earth magnets (see, the following Patent Literature 1 and Patent Literature 2). R-T-B based rare earth magnets are hereinafter sometimes referred to as "R-T-B based magnet".

CITATION LIST

Patent Literature

Patent Literature 1: WO 2006/098204 pamphlet
Patent Literature 2: WO 2006/043348 pamphlet

SUMMARY OF THE INVENTION

Technical Problem

It is believed that R-T-B based magnets have a nucleation-type coercivity mechanism. According to the nucleation-type coercivity mechanism, when magnetic field opposite to magnetization is applied to R-T-B based magnets, magnetization-reversal nuclei are generated in the vicinity of grain boundaries of a group of crystal particles (a group of main phase particles) constituting the R-T-B based magnets. These magnetization-reversal nuclei decrease the coercive force of the R-T-B based magnets.

In order to improve the coercive force of R-T-B based magnets, a heavy rare earth element such as Dy or Tb may be added as R to R-T-B based magnets. This addition of a heavy rare earth element increases an anisotropic magnetic field to prevent generation of magnetization-reversal nuclei, improving the coercive force. However, when an excess amount of the heavy rare earth element is added, saturation magnetization (saturation magnetic flux density) is decreased, resulting in the decrease in residual magnetic flux density as well. Therefore, a challenge for R-T-B based magnets is to balance the residual magnetic flux density and the coercive force. Especially, there is a need for improvements in the residual magnetic flux density and the coercive force for R-T-B based magnets to be incorporated into automobile motors and generators which have a recent increasing demand.

The present inventors came up with an idea that the coercive force and the residual magnetic flux density can be balanced by providing a heavy rare earth element only in the region where magnetization-reversal nuclei tend to be produced in order to increase an anisotropic magnetic field. Namely, the present inventors thought it is important to have a higher mass ratio of a heavy rare earth element in the vicinity of the surface of crystal particles constituting R-T-B based magnets than in the core (central part) of the crystal particles, and to have a higher mass ratio of a light rare earth element such as Nd or Pr in the core than in the vicinity of the surface. Accordingly, the coercive force might be increased due to high anisotropic magnetic field (Ha) in the vicinity of the surface, and the residual magnetic flux density might be increased due to high saturation magnetization (Is) in the core.

The present inventors sought to prepare, by using the production method disclosed in the above Patent Literature 1 or Patent Literature 2, R-T-B based magnets composed of crystal particles comprising a core having a high mass ratio of a light rare earth element and a shell covering the core and having a high mass ratio of a heavy rare earth element. However, it was difficult to sufficiently improve magnetic properties of the sintered magnets by using the production method disclosed in the above Patent Literature 1 or Patent Literature 2.

With the foregoing problems of conventional techniques in view, an object of the present invention is to provide a sintered magnet having superior residual magnetic flux density and coercive force, a motor comprising the sintered magnet, an automobile comprising the motor and a method for producing the sintered magnet.

Solution to Problem

In order to achieve the above object, the first embodiment of the sintered magnet of the present invention comprises a group of R-T-B based rare earth magnet crystal particles having a core and a shell covering the core, and a mass ratio of a heavy rare earth element in the shell is higher than a mass ratio of a heavy rare earth element in the core, and the thickest part of the shell in the crystal particles faces a grain boundary triple junction. Namely, according to the present invention, a part of the shell facing the grain boundary triple junction is thicker than the other parts in the shell. A group of crystal particles means a plurality of crystal particles. A grain boundary triple junction means a grain boundary in which three or more crystal particles face each other. According to the first embodiment, a lattice defect may be formed between the core and the shell.

The above sintered magnet of the present invention has superior residual magnetic flux density and coercive force compared to conventional R-T-B based magnets having a shell whose thickness is uniform throughout.

The second embodiment of the sintered magnet of the present invention comprises a group of R-T-B based rare earth magnet crystal particles having a core and a shell covering the core, and a mass ratio of a heavy rare earth element in the shell is higher than a mass ratio of a heavy rare earth element in the core, and a lattice defect is formed between the core and the shell. According to the second embodiment, the thickest part of the shell in the crystal particles may face a grain boundary triple junction.

The above sintered magnet of the present invention has superior residual magnetic flux density and coercive force compared to conventional R-T-B based magnets having no crystal defect between the core and the shell.

A method for producing the sintered magnet of the present invention comprises the first step of forming a sintered body by sintering a raw material alloy for an R-T-B based rare earth magnet, the second step of attaching, to the sintered body, a heavy rare earth compound containing a heavy rare earth element, the third step of heat-treating the sintered body to which the heavy rare earth compound has been attached, the fourth step of heat-treating the sintered body heat-treated in the third step, at a higher temperature than a heat treatment temperature in the third step and the fifth step of cooling the sintered body heat-treated in the fourth step, at a cooling rate of 20° C./min or more.

According to the method for producing the sintered magnet of the present invention, the above sintered magnet of the present invention can be obtained.

The motor of the present invention comprises the above sintered magnet of the present invention.

The sintered magnet of the present invention has high residual magnetic flux density. Thus, the sintered magnet of the present invention having the same volume and shape as a conventional R-T-B based magnet has higher magnetic flux than the conventional magnet. Accordingly, the motor comprising the sintered magnet of the present invention has improved energy conversion efficiency than before.

Even when the sintered magnet of the present invention has smaller volume than a conventional R-T-B based magnet, the sintered magnet of the present invention has an equivalent magnetic flux to the conventional magnet due to its high residual magnetic flux density. Namely, the sintered magnet of the present invention can be miniaturized compared to conventional magnets without decreasing magnetic flux. As a result, the volume of yokes and the amount of winding wires can be reduced due to the miniaturization of the sintered magnet according to the present invention, making it possible to obtain smaller and lighter motors.

The sintered magnet of the present invention has superior residual magnetic flux density and coercive force even under high temperature conditions. Namely, the sintered magnet of the present invention has superior thermal resistance. Therefore, the motor comprising the sintered magnet of the present invention generates less heat due to eddy currents compared to motors comprising conventional R-T-B based magnets. According to the present invention, motors can be designed with placing great importance on the energy conversion efficiency rather than on the prevention of heat generation.

The automobile of the present invention comprises the above motor of the present invention. Thus, the automobile of the present invention is driven by the motor of the present invention. According to the present invention, the automobile includes, for example, electric automobiles, hybrid automobiles or fuel cell vehicles driven by the motor of the present invention.

The automobile of the present invention has improved fuel consumption because it is driven by the motor of the present invention having improved energy conversion efficiency than before. In addition, the automobile of the present invention itself can be smaller and lighter because the motor can be smaller and lighter as described above. Accordingly, the automobile has improved fuel consumption.

The sintered magnet of the present invention has improved residual magnetic flux density and coercive force because the amount of the heavy rare earth element in the core is decreased and the amount of the heavy rare earth element is locally increased in the shell. Thus, the sintered magnet of the present invention has improved residual magnetic flux density and coercive force without adding the heavy rare earth element to the entire magnet as it has been done conventionally. Accordingly, the sintered magnet of the present invention can achieve sufficient residual magnetic flux density and coercive force even when it contains less amount of the heavy rare earth element compared to conventional R-T-B based magnets. This makes it possible to reduce the cost of the sintered magnet of the present invention by reducing the amount of expensive heavy rare earth element, without deteriorating magnetic properties. As a result, it is also possible to reduce the cost of the motor comprising the sintered magnet of the present invention and the automobile comprising the motor.

Advantageous Effect of the Invention

According to the present invention, it is possible to provide a sintered magnet having superior residual magnetic flux density and coercive force, a motor comprising the sintered magnet, an automobile comprising the motor and a method for producing the sintered magnet.

DESCRIPTION OF EMBODIMENTS

A preferred embodiment of the present invention is now described in detail with reference to the figures. In the figures, the same component is designated with the same symbol.

(Sintered Magnet)

Figure 1:
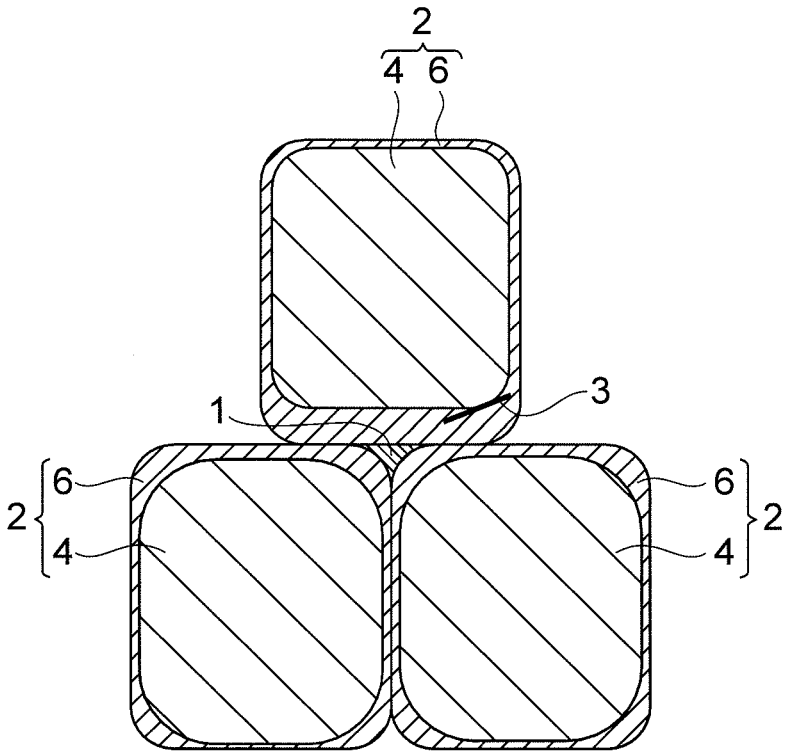
FIG. 1 is a partial sectional schematic view of a sintered magnet according to an embodiment of the present invention.

Crystal particles included in the sintered magnet according to the present embodiment is composed of an R-T-B based magnet (e.g. $R_2T_{14}B$). As shown in FIG. 1, a crystal particle 2 comprises a core 4 and a shell 6 covering the core 4. In the sintered magnet according to the present embodiment, a plurality of crystal particles 2 are sintered each other. The mass ratio (mass concentration) of a heavy rare earth element in the shell 6 is higher than the mass concentration of a heavy rare earth element in the core 4. Namely, in the sintered magnet, the mass concentration of a heavy rare earth element is the highest in the vicinity of the grain boundary of the crystal particle 2. When the core 4 or shell 6 contains two or more types of heavy rare earth elements, the mass concentration of a heavy rare earth element means the total mass concentration of these heavy rare earth elements.

Due to the nucleation-type coercivity mechanism of R-T-B based magnets, magnetization-reversal nuclei are generated in the vicinity of grain boundaries of the sintered main phase particles. The magnetization-reversal nuclei decrease the coercive force of the R-T-B based magnets. Thus, magnetization-reversal nuclei tend to be generated in the vicinity of the surface of the main phase particles. In the present embodiment, the mass concentration of a heavy rare earth element is locally increased in the shell 6 locating at the surface of the crystal particle 2. Namely, the mass concentration of a heavy rare earth element in the vicinity of grain boundaries of a group of crystal particles is increased. As a result, an anisotropic magnetic field in the vicinity of grain boundaries of a group of crystal particles is increased and thus the coercive force of the sintered magnet is increased. According to the present embodiment, the mass concentration of a heavy rare earth element in the core 4 is lower than in the shell 6, and thus the mass concentration of a light rare earth element in the core 4 is relatively higher than in the shell 6. As a result, saturation magnetization (Is) of the core 4 becomes higher, and thus the residual magnetic flux density of the sintered magnet is increased. When the core 4 has composition of $(Nd_{0.9}Dy_{0.1})_2Fe_{14}B$, for example, composition of the shell 6 is $(Nd_{0.3}Dy_{0.7})_2Fe_{14}B$.

The rare earth element R may be at least one selected from the group consisting of La, Ce, Pr, Nd, Pm, Sm, Eu, Gd, Tb, Dy, Ho, Er, Tm, Yb and Lu. The transition metal element T may be at least one of Fe and Co. The light rare earth element may be at least one selected from the group consisting of La, Ce, Pr, Nd, Pm, Sm and Eu. The heavy rare earth element may be at least one selected from the group consisting of Gd, Tb, Dy, Ho, Er, Tm, Yb and Lu. The sintered magnet may optionally further contain other elements such as Co, Ni, Mn, Al, Cu, Nb, Zr, Ti, W, Mo, V, Ga, Zn, Si, Bi and the like. The sintered magnet according to the present embodiment may have composition of, for example:

R: 29.0 to 33.0% by mass,
B: 0.85 to 0.98% by mass,
Al: 0.03 to 0.25% by mass,
Cu: 0.01 to 0.15% by mass,
Zr: 0.03 to 0.25% by mass,
Co: 3% by mass or less (excluding 0% by mass),
Ga: 0 to 0.35% by mass,
O: 2500 ppm or less,
C: 500 ppm to 1500 ppm, and
Fe: balance.

However, composition of the sintered magnet is not limited to the above.

The shell 6 preferably contains Dy or Tb as a heavy rare earth element. The shell 6 more preferably contains Dy and Tb. $R_2T_{14}B$ compounds containing Dy or Tb have higher anisotropic magnetic field than that of $R_2T_{14}B$ compounds containing a light rare earth element such as Nd, Pr and the like. Due to inclusion of a $R_2T_{14}B$ compound containing Dy or Tb in the shell 6, the coercive force can be improved.

The difference in the mass concentrations of a heavy rare earth element between the core 4 and the shell 6 is preferably 1 to 10% by mass or more, more preferably 2 to 10% by mass, and the most preferably 3 to 10% by mass.

When the difference in the mass concentrations of a heavy rare earth element between the core and shell is low, the mass concentration of a heavy rare earth element in the outermost shell (shell 6) of the crystal particle 2 tends to be decreased, thereby decreasing the improvement in the coercive force. When the difference in the mass concentrations of a heavy rare earth element between the core and shell is high, the heavy rare earth element can be easily heat-diffused from the shell 6 to the core 4 during the production process of the sintered magnet (the third or fourth step). As a result, the improvement in the coercive force commensurate with the added amount of the heavy rare earth element is not obtained, so that saturation magnetization of the core 4 and thus the residual magnetic flux density of the sintered magnet tend to be decreased. However, even when the difference in the mass concentrations of a heavy rare earth element between the core and shell is at the outside of the above range, the effect of the present invention can be achieved.

The mass concentration of a light rare earth element in the core 4 may be about 17 to 27% by mass. The mass concentration of a heavy rare earth element in the shell 6 may be about 1 to 15% by mass. The mass concentration of a heavy rare earth element in the core 4 may be about 0 to 10% by mass.

The mass concentration of the element T in the core 4 or shell 6 may be about 65 to 75% by mass. The mass concentration of B in the core 4 or shell 6 may be about 0.88 to 2.0% by mass. However, when the mass concentrations of the elements T and B are at the outside of the above ranges, the effect of the present invention can be achieved.

The thickest part of the shell 6 in the crystal particle 2 faces a grain boundary triple junction 1. In other words, the shells 6 of all crystal particles 2 facing the grain boundary triple junctions 1 are the thickest at the part facing the grain boundary triple junction 1. Composition of the grain boundary triple junction 1 is not definite, but is different from compositions of the core 4 and shell 6. Not all grain boundary triple junctions may face the thickest part of the shell of crystal particles.

When the entire surface of the core 4 is covered with the shell 6 having a uniform thickness and having high mass concentration of a heavy rare earth element in order to increase the coercive force, the volume of the core 4 having high mass concentration of a light rare earth element in the crystal particle is relatively decreased. As a result, the residual magnetic flux density of the sintered magnet is decreased. On the other hand, according to the present embodiment, only the part of the shell 2 facing the grain boundary triple junction 1 is locally thick and the shell 2 at the interface of two particles is thin. As a result, the coercive force is improved due to an anisotropic magnetic field of the shell 6, as well as the residual magnetic flux density is hard to be decreased because the volume of the core 4 is not relatively decreased. The detail of the relationship between the grain boundary triple junction 1 and the coercive force is unknown. The present inventors think that magnetization-reversal nuclei are easily produced at around grain boundary triple junctions 1 rather than at the interface of two particles. The present inventors think that when the shell 6 having a high mass concentration of a heavy rare earth element is thick in the vicinity of the grain boundary triple junction 1, generation of magnetization-reversal nuclei is prevented, thereby improving the coercive force. The interface of two particles means a grain boundary of adjacent two crystal particles.

The thickest part of the shell 6 may be, not only at the grain boundary triple junction 1, but also in the range within 3 μm from the grain boundary triple junction 1 along the interface of two particles continued from the grain boundary triple junction 1. Thus, the thickness of the shell facing the grain boundary triple junction 1 and a part of the interface of two particles may be uniform. In this case, however, the thickness of the shell facing the grain boundary triple junction 1 and a part of the interface of two particles is higher than the thickness of the shell in other parts. The thickness of the shell 6 facing the grain boundary triple junction 1 is preferably 200 to 1000 nm, more preferably 300 to 1000 nm, and the most preferably 500 to 900 nm. When the thickness of the shell 6 facing the grain boundary triple junction 1 is small, the improvement in the coercive force is decreased. When the shell 6 facing the grain boundary triple junction 1 is too thick, the size of the core 4 is relatively decreased, resulting in decrease in its saturation magnetization and in the improvement in the residual magnetic flux density. The thickness of the shell 6 at the interface of two particles is preferably 5 to 100 nm, more preferably 10 to 80 nm, and the most preferably 10 to 50 nm. Even when the thickness of the shell 6 is at the outside of the above ranges, the effect of the present invention can be achieved. The particle diameter of the crystal particle 2 may be about 10 μm or less or 5 μm or less.

A lattice defect 3 is formed between the core 4 having high residual magnetic flux density and the shell 6 having high anisotropic magnetic field. In the lattice defect 3, the crystal structure of the core 4 does not match to that of the shell 6. Specific examples of the lattice defect 3 include dislocation (line defect), grain boundary (planar defect) and point defect such as interstitial atom, atomic vacancy and the like. The formation of the lattice defect 3 improves the coercive force.

The reason is not known why the formation of the lattice defect 3 can improve the coercive force. The present inventors think as follows. When, for example, the core 4 contains the crystal phase of $Nd_2Fe_{14}B$ and the shell 6 contains the crystal phase of $Dy_2Fe_{14}B$ or $Tb_2Fe_{14}B$, the core 4 and the shell 6 have the same type of the crystal structures. However, the lattice constants between the core 4 and the shell 6 are slightly different, resulting in the distortion of the crystal structures between the core 4 and the shell 6. This distortion may deteriorate magnetic properties such as a coercive force. If a lattice defect 3 is not formed between the core 4 and the shell 6, the distortion of the crystal structures between the core 4 and the shell 6 is increased when a higher amount of a heavy rare earth element is solid-dispersed in the shell 6. This increase in the distortion of the crystal structures increases the deterioration of magnetic properties. The relieving of the distortion of the crystal structures between the core 4 and the shell 6 due to the formation of the lattice defect 3 improves the coercive force. The reason of improvement in the coercive force due to the formation of the lattice defect 3 is, however, not limited to the above.

It is preferred that the lattice defect 3 is formed between the shell 6 facing the grain boundary triple junction 1 and the core 4, because this can significantly increase the coercive force.

The percentage of crystal particles 2 in which the thickest part of the shell 6 faces the grain boundary triple junction 1 is preferably 10% by volume or more, more preferably 30% by volume or more and the most preferably 50% by volume or more relative to the entire sintered magnet. The increased percentage of the crystal particles 2 in the sintered magnet can increase the effect of improving the coercive force. The effect of improving the coercive force is produced by the interaction between crystal particles; however, it is not necessary that all groups of crystal particles contained in the sintered magnet have the structure shown in FIG. 1. Even when the percentage of the crystal particles 2 in which the thickest part of the shell 6 faces the grain boundary triple junction 1 is less than 10% by volume, the effect of the present invention can be achieved. Due to the same reason as described above, the percentage of crystal particles 2 in which a lattice defect is formed between the core 4 and the shell 6 is preferably 10% by volume or more, more preferably 30% by volume or more and the most preferably 50% by volume or more relative to the entire sintered magnet. However, it is not necessary that a lattice defect is formed in all crystal particles contained in the sintered magnet.

The grain boundary triple junction 1 and the lattice defect 3 can be confirmed with a scanning transmission electron microscope with energy dispersive X-ray spectroscope (STEM-EDS). The percentage in volume of crystal particles 2 relative to the entire sintered magnet, the particle diameter of crystal particles 2, the diameter of the core 4 and the thickness of the shell 6 may be determined by analyzing photos of the sintered magnet obtained by STEM-EDS. The core 4, shell 6 and grain boundary triple junction 1 may be distinguished with an electron probe microanalyzer (EPMA). Composition analyses of crystal particles 2 may also be suitably carried out by STEM-EDS and EPMA.

(Production Method of Sintered Magnet)

The method for producing the sintered magnet according to the present embodiment comprises the first, second, third and fourth steps. In the first step, a raw material alloy for R-T-B based magnets is sintered to obtain a sintered body. In the second step, a heavy rare earth compound containing a heavy rare earth element is attached to the sintered body. In the third step, the sintered body to which the heavy rare earth compound has been attached is heat-treated. In the fourth step, the sintered body heat-treated in the third step is heat-treated at a higher temperature than a heat treatment temperature in the third step. In the fifth step, the sintered body heat-treated in the fourth step is cooled at a cooling rate of 20° C./min or more. These steps are hereinafter described in detail.

<First Step>

In the first step, an R-T-B based alloy containing the elements R, T and B may be used as a raw material alloy. Chemical composition of the raw material alloy may be appropriately adjusted according to the desired final chemical composition of crystal particles. The raw material alloy may preferably contain at least either of heavy rare earth elements of Dy and Tb.

It is preferred that the raw material alloy contains Zr. Zr tends to deposit in the vicinity of main phase crystal particles at the grain boundary triple junction during the third or fourth step. Zr then appropriately inhibits diffusion of the heavy rare earth element segregated in the vicinity of the grain boundary triple junction into crystal particles. Namely, addition of Zr in the raw material alloy facilitates the control of diffusion of the heavy rare earth element from the grain boundary triple junction into crystal particles and local thickening of the shell 6 at the grain boundary triple junction. The amount of Zr to be added relative to the raw material alloy may be about 2000 ppm by mass or less.

The content of B in the raw material alloy is preferably 2.0% by mass or less, more preferably 0.95% by mass or less, and the most preferably 0.90% by mass or less. When the B content is high, a B-rich phase ($RT_4B_4$) tends to be deposited in the sintered magnet. The B-rich phase tends to inhibit diffusion of the heavy rare earth element through grain boundaries during the third step. As a result, segregation of the heavy rare earth element into grain boundary triple junctions may be moderated. The B content in the raw material alloy is preferably 0.88% by mass or more. When the B content is low, a $R_2T_{17}$ phase tends to be deposited in the sintered magnet. The $R_2T_{17}$ phase tends to decrease the coercive force of the sintered magnet. However, even when the B content of the raw material alloy is at the outside of the above range, the sintered magnet of the present embodiment can be prepared.

In a step of preparation of the raw material alloy, elementary substances, alloys, compounds and the like containing metal elements or the like corresponding to composition of the R-T-B based magnet, for example, are melted in a vacuum or an inert gas atmosphere such as Ar and the like, and then casting or strip casting process may be carried out. Accordingly, the raw material alloy having desired composition can be prepared.

The raw material alloy is coarsely ground into particles having a particle diameter of the order of a few hundreds of micrometers. The raw material alloy may be coarsely ground with a coarse grinding machine such as a jaw crusher, a Brown mill, a stamp mill and the like. The raw material alloy is preferably coarsely ground in an inert gas atmosphere. The raw material alloy may be subjected to hydrogen absorption grinding. By hydrogen absorption grinding, the raw material alloy is allowed to absorb hydrogen before heated in an inert gas atmosphere and is coarsely ground by auto-disruption caused by the difference in the amount of absorbed hydrogen between different phases.

The coarsely ground raw material alloy may be finely ground until the particle diameter of 1 to 10 μm is obtained. Fine grinding may be carried out in a jet mill, ball mill, vibration mill, wet attritor and the like. Additives such as zinc stearate, oleamide and the like may be added to the raw material alloy. This can improve orientation of the raw material alloy during molding.

The ground raw material alloy is subjected to pressure molding in magnetic fields to form a compact. Magnetic fields during pressure molding may be about 950 to 1600 kA/m. The pressure during pressure molding may be about 50 to 200 MPa. The shape of the compact may be, but not limited to, column, disc, ring and the like.

The compact is sintered in a vacuum or an inert gas atmosphere to form a sintered body. The sintering temperature may be adjusted according to various conditions such as composition of the raw material alloy, grinding process, particle size, particle size distribution. The sintering temperature may be 900 to 1100° C., and the sintering period may be about 1 to 5 hours.

The sintered body is composed of a plurality of sintered main phase particles. Composition of main phase particles is almost the same as composition of the core 4 of the crystal particles 2 included in the sintered magnet. However, the main phase particles do not have the shell 6.

The oxygen content of the sintered body is preferably 3000 ppm by mass or less, more preferably 2500 ppm by mass or less, and the most preferably 1000 ppm by mass or less. Decreased oxygen amount reduces impurities in the obtained sintered magnet, thereby improving magnetic properties of the sintered magnet. When the oxygen amount is high, oxides in the sintered body may prevent diffusion of the heavy rare earth element and the shell 6 is difficult to be formed during the third or fourth step, so that there is a tendency that the heavy rare earth element is difficult to segregate at the grain boundary triple junction 1. The way to decrease the oxygen content of the sintered body may include maintaining the raw material alloy under a low oxygen concentration atmosphere from hydrogen absorption grinding through sintering. However, even when the oxygen content of the sintered body is at the outside of the above range, the sintered magnet of the present embodiment can be prepared.

The particle diameter of main phase particles constituting the sintered body is preferably 15 μm or less, and more preferably 10 μm or less. When the particle diameter of main phase particles is high, it may be difficult to uniformly attach the heavy rare earth compound on the surface of the sintered body in the second step. The particle diameter of main phase particles can be controlled by adjusting the particle diameter of the ground raw material alloy, the sintering temperature, the sintering period and the like. However, even when the particle diameter of main phase particles is at the outside of the above range, the sintered magnet of the present embodiment can be prepared.

After processing the sintered body into a desired shape, the surface thereof may be treated with an acidic solution. The acidic solution for surface treatment is suitably a mixed solution of an aqueous solution of nitric acid, hydrochloric acid and the like and an alcohol. In this surface treatment, the sintered body may, for example, be soaked in the acidic solution or be sprayed with the acidic solution. Surface treatment allows removal of a dirt or oxide layer attached to the sintered body and provides clean surface, so that the heavy rare earth compound can be ensured to attach and diffuse as described below. In view of further sufficiently removing a dirt or oxide layer, ultrasonic may be applied to the acidic solution during surface treatment.

<Second Step>

The heavy rare earth compound containing the heavy rare earth element is attached on the surface of the surface-treated sintered body. The heavy rare earth compound may include alloys, oxides, halides, hydroxides, hydrides and the like, among which hydrides are particularly preferred. When a hydride is used, only the heavy rare earth element contained in the hydride diffuses into the sintered body in the third or fourth step. Hydrogen contained in the hydride is released from the sintered body during the third or fourth step. Thus, by using a hydride of a heavy rare earth element, the final sintered magnet does not contain remained impurities derived from the heavy rare earth compound, so that decrease in the residual magnetic flux density of the sintered magnet can be easily prevented. The hydride of the heavy rare earth may include $DyH_2$, $TbH_2$ or a hydride of Dy—Fe or Tb—Fe, among which $DyH_2$ or $TbH_2$ is particularly preferred. Use of $DyH_2$ or $TbH_2$ may facilitate segregation of Dy or Tb in the vicinity of grain boundary triple junctions of main phase particles and increase the mass concentration of Dy or Tb in the shell 6 facing the grain boundary triple junctions in the third or fourth, step. When a hydride of Dy—Fe is used, Fe also tends to diffuse into the sintered body in the heat treatment step. When a fluoride or oxide of the heavy rare earth element is used, fluorine or oxygen tends to diffuse into the sintered body during heat treatment to remain in the sintered magnet, deteriorating magnetic properties. Thus, fluorides and oxides of the heavy rare earth element are not preferable as the heavy rare earth compound to be used in the present embodiment.

The heavy rare earth compound to be attached to the sintered body is preferably particulate with the average particle diameter being preferably 100 nm to 50 μm, and more preferably 1 μm to 10 μm. When the particle diameter of the heavy rare earth compound is less than 100 nm, excess amount of the heavy rare earth compound may diffuse into the sintered body during the third or fourth step, thereby decreasing the residual magnetic flux density of the rare earth magnet. When the particle diameter exceeds 50 μm, the heavy rare earth compound may be difficult to diffuse into the sintered body, thereby resulting in insufficient effect of improving the coercive force.

The heavy rare earth compound can be attached to the sintered body by the methods, for example, wherein particles of the heavy rare earth compound are directly sprayed to the sintered body, wherein a solution of the heavy rare earth compound in a solvent is applied on the sintered body, wherein a diffusing agent in the form of slurry in which particles of the heavy rare earth compound are dispersed in a solvent is applied on the sintered body, and wherein the heavy rare earth element is deposited. Among them, it is preferred that a diffusing agent is applied on the sintered body. Use of the diffusing agent allows uniform attachment of the heavy rare earth compound on the sintered body, so that diffusion of the heavy rare earth element can surely proceed in the third or fourth step. In the following, the case where the diffusing agent is used is described.

The solvent for the diffusing agent is preferably the one which allows uniform diffusion of the heavy rare earth compound without dissolving thereof. The solvent may include, for example, alcohols, aldehydes, ketones and the like, among which ethanol is preferred. The sintered body may be soaked in the diffusing agent or be added dropwise with the diffusing agent.

When the diffusing agent is used, the content of the heavy rare earth compound in the diffusing agent may be appropriately adjusted according to a target mass concentration of the heavy rare earth element in the shell 6. For example, the content of the heavy rare earth compound in the diffusing agent may be 10 to 50% by mass or 40 to 50% by mass. When the content of the heavy rare earth compound in the diffusing agent is at the outside of these ranges, there is a tendency that the heavy rare earth compound may not uniformly attach to the sintered body. When the content of the heavy rare earth compound in the diffusion agent is too high, the surface of the sintered body becomes rough, making it difficult to carry out plating or the like in order to improve the corrosion resistance of the resulting magnet. However, even when the content of the heavy rare earth compound in the dispersing agent is at the outside of the above ranges, the effect of the present invention can be achieved.

The diffusing agent may optionally further comprise other components than the heavy rare earth compound. The other components which may be contained in the diffusing agent may include, for example, a dispersing agent for preventing aggregation of heavy rare earth compound particles.

<Third Step and Fourth Step>

In the third and fourth steps, the sintered body to which the diffusing agent has been applied is subjected to heat treatment. By heat treatment, the heavy rare earth compound attached on the surface of the sintered body diffuses into the sintered body. The heavy rare earth compound diffuses along grain boundaries in the sintered body. The mass concentration of the heavy rare earth element in grain boundaries is higher than that in main phase particles constituting the sintered body. The heavy rare earth element heat-diffuses from the region where their mass concentration is high to the region where it is low. Thus, the heavy rare earth element diffused in grain boundaries heat-diffuses into main phase particles. As a result, the shell 6 containing the heavy rare earth element derived from the diffusing agent is formed. Accordingly, the crystal particle 2 of the R-T-B based magnet comprising the core 4 and the shell 6 is formed.

In the third step (grain boundary diffusion step), the sintered body to which the diffusing agent has been applied is heat-treated. The present inventors believe that, by the third step, the heavy rare earth compound in the diffusing agent diffuses from the surface of the sintered body to grain boundaries in the sintered body. Namely, the present inventors think that diffusion of the heavy rare earth element to grain boundary triple junctions of main phase particles is promoted by the third step. In the fourth step (intra-particle diffusion step), the sintered body which has been heat-treated in the third step is heat-treated at a higher temperature than the heat treatment temperature in the third step. The present inventors think that the heavy rare earth element diffused in grain boundaries diffuse into main phase particles by the fourth step. Namely, the present inventors think that the heavy rare earth element diffuses from grain boundary triple junctions to the inside of main phase particles by the fourth step. By dividing heat treatment of the sintered body into two steps and employing a higher heat treatment temperature in the fourth step than that in the third step, a part of the shell 6 facing the grain boundary triple junction 1 can be locally thickened. In addition, by dividing heat treatment of the sintered body into two steps, the mass concentration of the heavy rare earth element can be easily increased in the shell 6 relative to the core 4, thereby facilitating formation of the lattice defect 3 between the core 4 and the shell 6.

The heat treatment temperature in the third step may be 500 to 850° C., while that in the fourth step may be 800 to 1000° C. Controlling heat treatment temperatures in the third and fourth steps to these ranges may facilitate locally thickening a part of the shell 6 facing the grain boundary triple junction 1. Even when heat treatment temperatures are at the outside of these ranges, it is preferred that the difference in heat treatment temperatures between the third and fourth steps is 100° C. or more, because it facilitates locally thickening a part of the shell 6 facing the grain boundary triple junction 1.

<Fifth Step>

In the fifth step, the sintered body immediately after the fourth step is cooled at a cooling rate of 20° C./min or more. Preferably, the sintered body immediately after the fourth step is cooled at a cooling rate of about 50° C./min. The rapid cooling of the sintered body at a cooling rate of 20° C./min or more can stop diffusion of the heavy rare earth element in the sintered body and allow formation of the lattice defect 3 between the core 4 and the shell 6. When the cooling rate is less than 20° C./min, it is difficult to form the lattice defect 3 between the core 4 and the shell 6. The upper limit of the cooling rate may be about 200° C./min. The temperature of the sintered body after cooling may be about 20 to 500° C.

According to the above first to fifth steps, the sintered magnet of the present invention can be obtained.

The resulting sintered magnet may be subjected to aging treatment. Aging treatment contributes to improvement in magnetic properties of the sintered magnet (particularly the coercive force). The sintered body may be provided on its surface with a plating layer, an oxide layer or a resin layer. These layers act as protection layers for preventing deterioration of the magnet.

(Motor)

Figure 2:
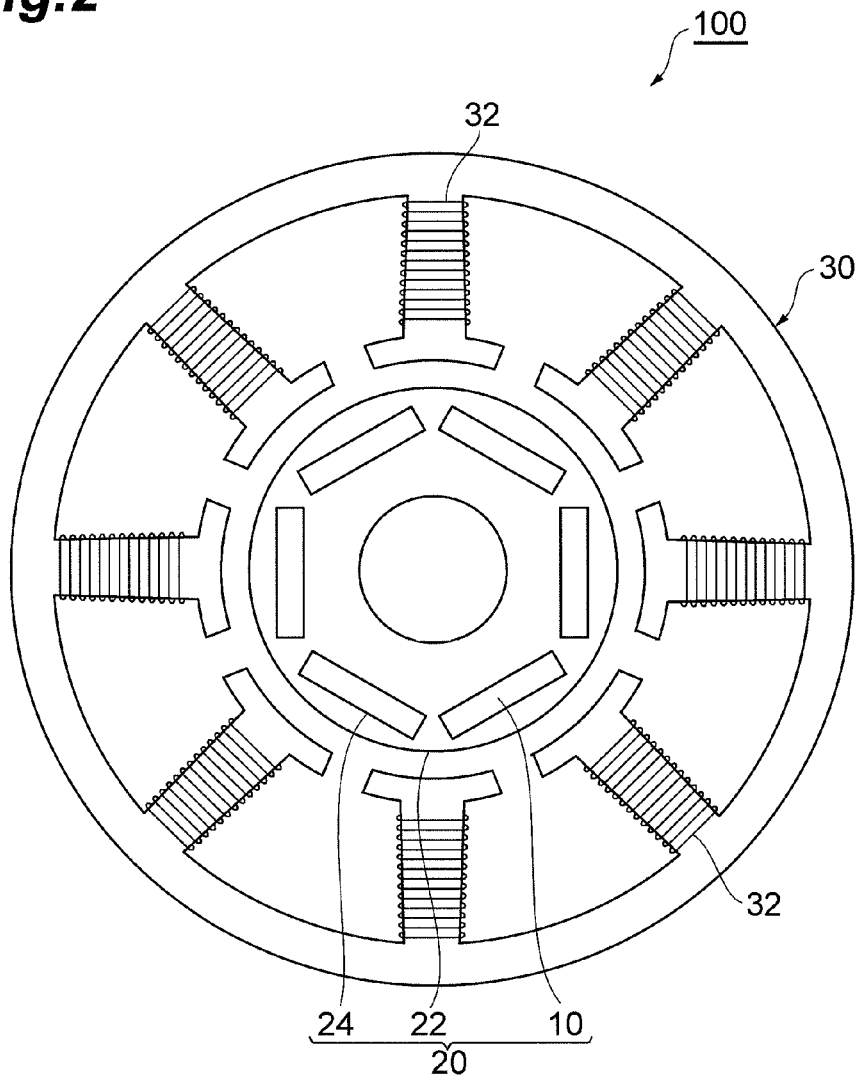
FIG. 2 is a schematic view of the inner structure of a motor according to an embodiment of the present invention.

As shown in FIG. 2, the motor 100 of the present embodiment is a permanent magnet synchronous motor (IPM motor); and comprises a cylindrical rotor 20 and a stator 30 located at the outside of the rotor 20. The rotor 20 has a cylindrical rotor core 22, a plurality of magnet containing parts 24 for containing rare earth sintered magnets 10 along the peripheral surface of the cylindrical rotor core 22 at certain intervals, and a plurality of rare earth sintered magnets 10 contained in the magnet containing parts 24.

The rare earth sintered magnets 10 adjacent to each other along the circumference of the rotor 20 are contained in the magnet containing parts 24 such that the north pole and the south pole are in opposite positions each other. Accordingly, the rare earth sintered magnets 10 circumferentially adjacent to each other generate magnetic field lines opposite to each other in a radial direction of the rotor 20.

The stator 30 has a plurality of coil parts 32 along the peripheral surface of the rotor 20 at certain intervals. The coil parts 32 are provided so that they face rare earth sintered magnets 10. The stator 30 torques the rotor 20 through electromagnetic action, so that the rotor 20 circumferentially rotates.

The IPM motor 100 comprises in the rotor 20 rare earth sintered magnets 10 according to the above embodiment. Due to the superior magnetic properties of the rare earth sintered magnets 10, the IPM motor 100 can achieve high output. The IPM motor 100 is produced in the same manner as conventional methods using conventional motor parts other than the method for producing the rare earth sintered magnets 10.

(Automobile)

Figure 3:
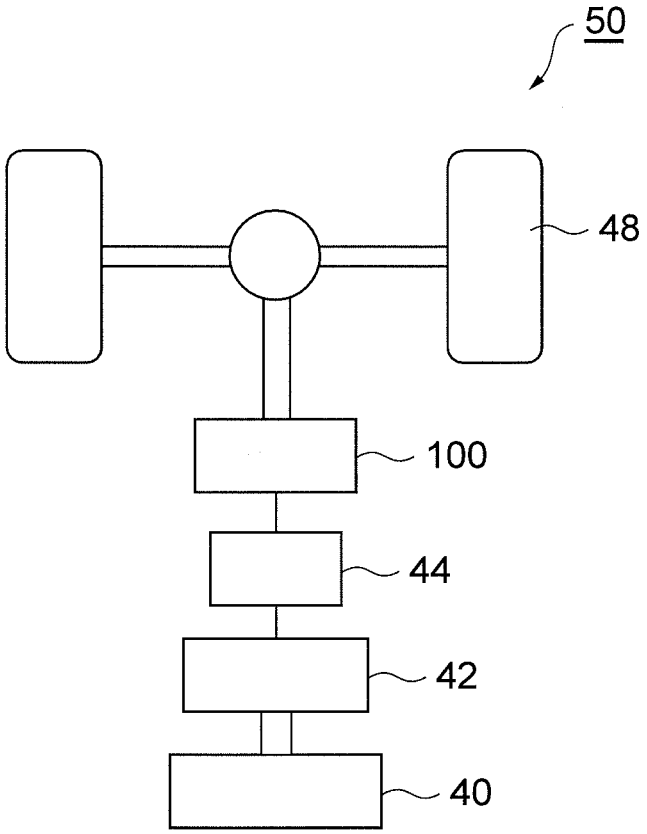
FIG. 3 is a conceptual view of an automobile according to an embodiment of the present invention.

FIG. 3 is a conceptual view illustrating a power generation mechanism, a power storage mechanism and a driving mechanism of the automobile according to the present embodiment. The structure of the automobile of the present embodiment is, however, not limited to the one shown in FIG. 3. As shown in FIG. 3, the automobile 50 according to the present embodiment comprise the motor 100 according to the present embodiment, wheels 48, a storage battery 44, a generator 42 and an engine 40.

Mechanical energy generated at the engine 40 is converted to electrical energy by means of the generator 42. The electrical energy is stored in the storage battery 44. The stored electrical energy is converted to mechanical energy by means of the motor 100. Mechanical energy from the motor 100 rotates wheels 48 and drives the automobile 50. Mechanical energy generated at the engine 40 may be directly used to rotate wheels 48 without using the storage battery 44 and the generator 42.

A preferred embodiment of the present invention has been described in detail; however, the present invention is not limited to the above embodiment.

For example, the generator comprised of the present automobile may contain the sintered magnet of the present invention. This allows, as similar to the motor, miniaturization of the generator and improvement in generation efficiency.

The motor of the present invention is not limited to, in the case of permanent magnet synchronous motors, IPM motors, and may be a SPM motor. The present motor may be, in addition to permanent magnet synchronous motors, permanent magnet direct current motors, linear synchronous motors, voice coil motors or vibration motors.

EXAMPLES

Example 1

First Step

A raw material alloy having composition of 31 wt % Nd-0.2 wt % Al-0.5 wt % Co-0.07 wt % Cu-0.15 wt % Zr-0.9 wt % Ga-0.9 wt % B-bal. Fe was prepared by strip casting. The raw material alloy was prepared into powder by hydrogen absorption grinding. During hydrogen absorption grinding, the raw material alloy was subjected to hydrogen absorption followed by dehydrogenation at 600° C. for 1 hour in an Ar atmosphere.

The raw material alloy powder and oleamide as a grinding aid were mixed for 10 min in a Nauta mixer prior to fine grinding in a jet mill to obtain fine powder having an average particle diameter of 4 μm. The amount of oleamide added was adjusted to 0.1% by mass relative to the raw material alloy.

Fine powder was loaded in a metal mold placed among electromagnets for molding in magnetic fields to obtain a compact. Molding was carried out while magnetic fields of 1200 kA/m and pressure of 120 MPa were applied to fine powder.

The compact was sintered at 1050° C. for 4 hours in a vacuum before rapid cooling to obtain a sintered body. All the steps from hydrogen absorption grinding through sintering were carried out in an atmosphere with an oxygen concentration of lower than 100 ppm.

Second Step

The sintered body was processed into a dimension of 10 mm×10 mm×3 mm. A diffusing agent containing $DyH_2$ was applied on the processed sintered body. The diffusing agent used was a slurry of $DyH_2$ dispersed in an organic solvent. The amount of the diffusing agent applied was adjusted so that the percentage of $DyH_2$ is 0.8% by mass relative to the sintered body.

Third Step and Fourth Step

In the third step, the sintered body onto which the diffusing agent was applied was heat-treated at 600° C. for 48 hours in an Ar atmosphere. In the fourth step after the third step, the sintered body was heat-treated at 800° C. for 1 hour in an Ar atmosphere.

Fifth Step

In the fifth step, the sintered body obtained immediately after the fourth step was cooled to 300° C. at a cooling rate of 50° C./min. The cooled sintered body was subjected to aging treatment at 540° C. for 2 hours in an Ar atmosphere. Accordingly, a sintered magnet of example 1 was obtained.

Example 2

In example 2, a sintered magnet of example 2 was obtained according to the same manner as example 1 except that a cooling rate of the sintered body in the fifth step was 20° C./min and the cooled sintered body was not subjected to aging treatment.

Comparative Example 1

In comparative example 1, a sintered body was prepared in the same manner as example 1. In comparative example 1, the diffusing agent was applied on the sintered body as example 1. However, the third step was omitted from the heat treatment in comparative example 1. Namely, the sintered body onto which the diffusing agent was applied was heat-treated at 900° C. for 4 hours in an Ar atmosphere, and the sintered body was cooled to 300° C. at a cooling rate of 50° C./min. The cooled sintered body was subjected to aging treatment at 540° C. for 2 hours in an Ar atmosphere. Accordingly, the sintered magnet of comparative example 1 was obtained.

Comparative Example 2

A sintered magnet of comparative example 2 was prepared in the same manner as example 1 except that a cooling rate in the fifth step was 10° C./min.

[Composition Analysis]

The sintered magnets of examples 1 and 2 and comparative examples 1 and 2 were analyzed by STEM-EDS and EPMA.

Figure 4:
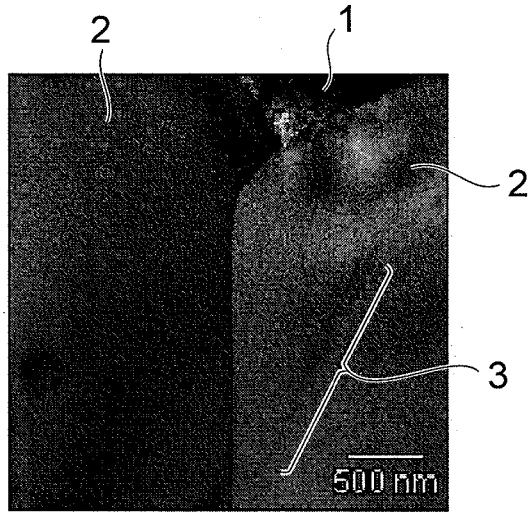
FIG. 4 includes FIGS. 4(*a*), 4(*b*) and 4(*c*) showing photographs of the sintered magnet of example 1 of the present invention.
Figure 4:
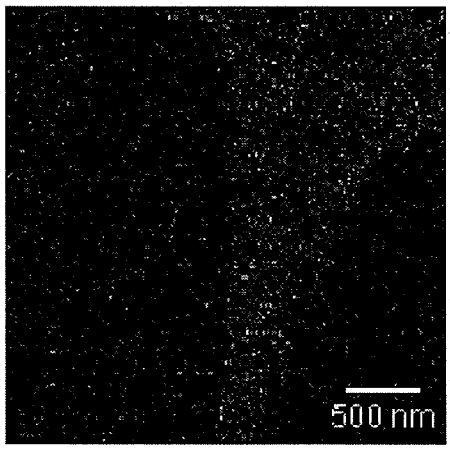
Figure 4:
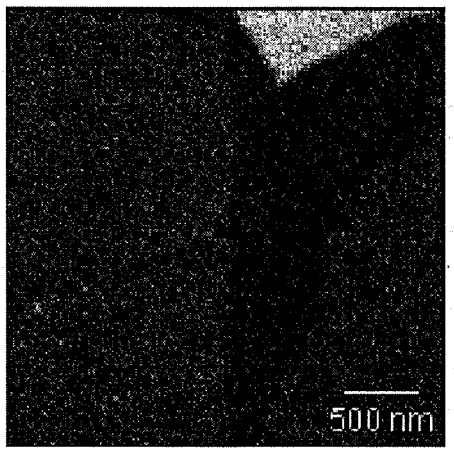

FIG. 4(*a*) is a photograph of the sintered magnet of example 1 obtained by STEM. The photographs of FIGS. 4(*b*) and 4(*c*) correspond to the same area of the sintered magnet as in FIG. 4(*a*). FIGS. 4(*b*) and 4(*c*) are the photographs constructed from M-line of Dy and L-line of Nd measured by STEM-EDS, respectively. In FIG. 4(*c*), the darkest parts correspond to shells of crystal particles.

Figure 5:
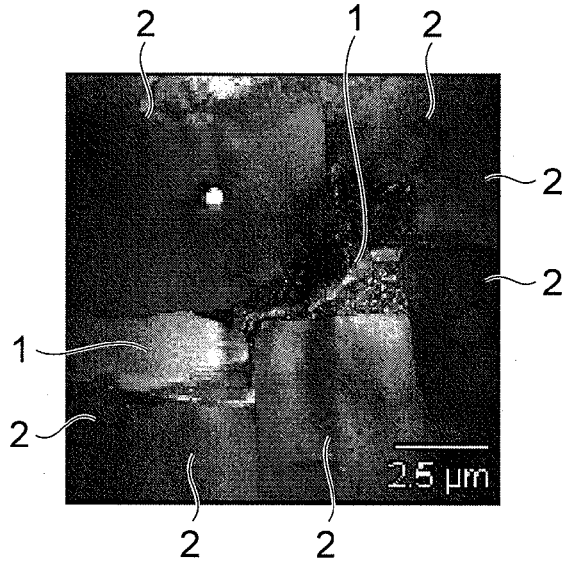
FIG. 5 includes FIGS. 5(*a*), 5(*b*) and 5(*c*) showing photographs of the sintered magnet of example 0.1 of the present invention.
Figure 5:
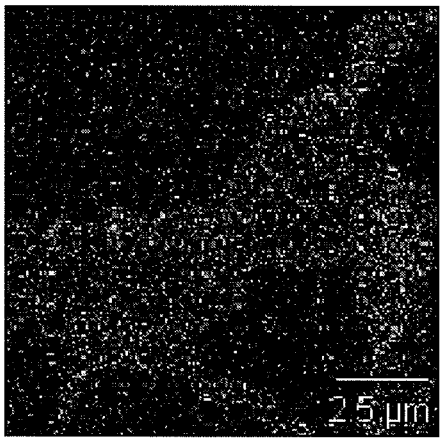
Figure 5:
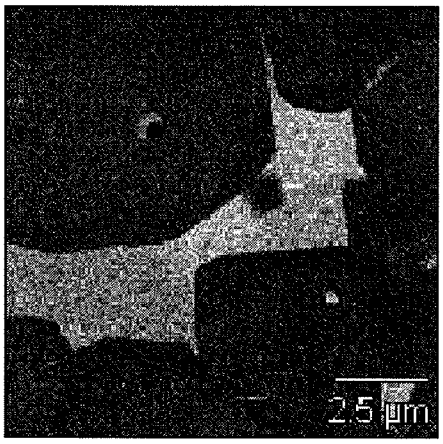

FIG. 5(*a*) is a photograph of the sintered magnet of example 1 obtained by STEM. The photograph of FIG. 5(*a*) corresponds to the same sintered magnet as FIG. 4(*a*). FIG. 4(*a*) is a magnified view of FIG. 5(*a*). The correlation between FIGS. 5(*a*), b5(*b*) and 5(*c*) is the same as that of FIGS. 4(*a*), 4(*b*) and 4(*c*).

Figure 6:
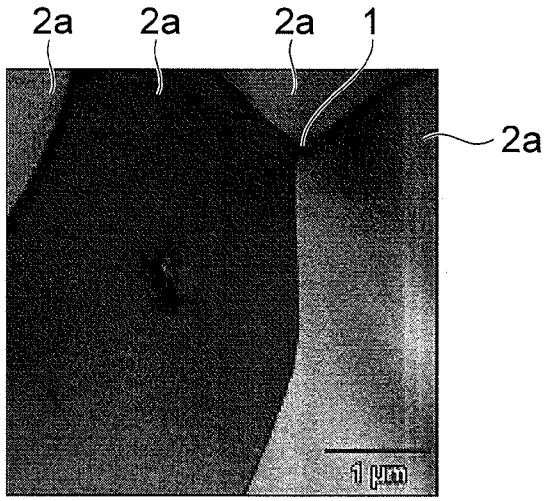
FIG. 6 includes FIGS. 6(*a*), 6(*b*) and 6(*c*) showing photographs of the sintered magnet of comparative example 1.
Figure 6:
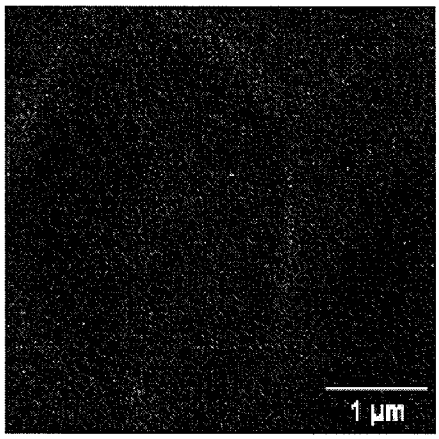
Figure 6:
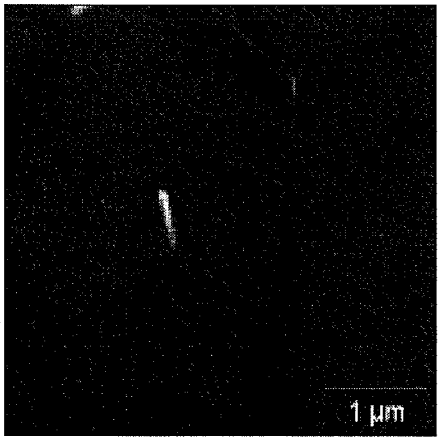

FIG. 6(*a*) is a photograph of the sintered magnet of comparative example 1 obtained by STEM. The correlation between FIGS. 6(*a*), b6(*b*) and 6(*c*) is the same as that of FIGS. 4(*a*), 4(*b*) and 4(*c*).

Figure 7:
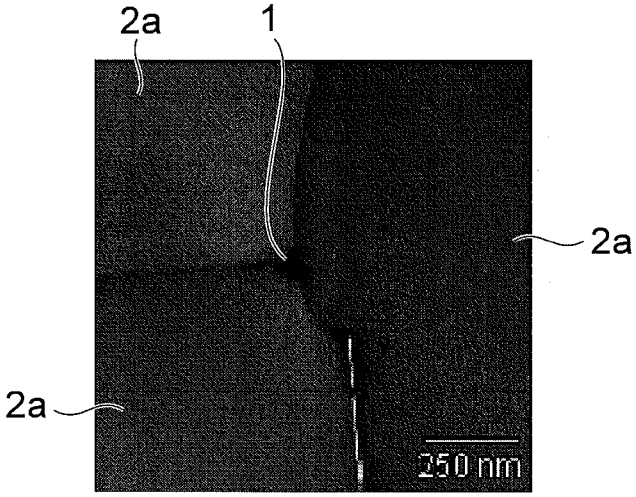
FIG. 7 includes FIGS. 7(*a*), 7(*b*) and 7(*c*) showing photographs of the sintered magnet of comparative example 2.
Figure 7:
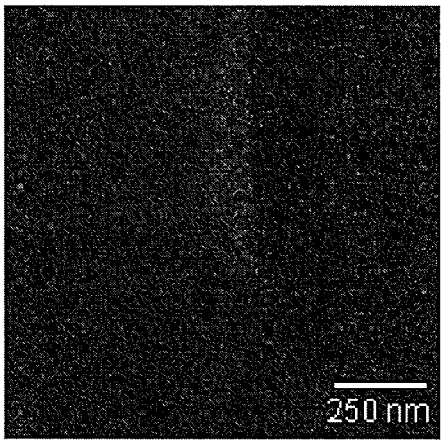
Figure 7:
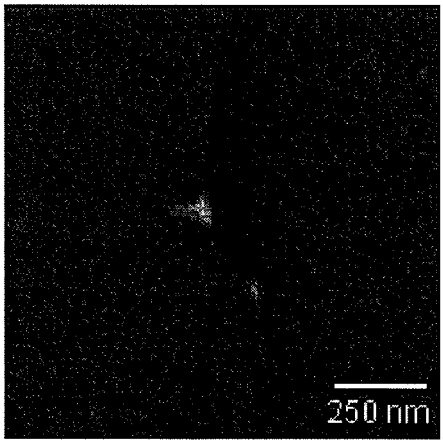

FIG. 7(*a*) is a photograph of the sintered magnet of comparative example 2 obtained by STEM. The correlation between FIGS. 7(*a*), 7(*b*) and 7(*c*) is the same as that of FIGS. 4(*a*), 4(*b*) and 4(*c*).

The results of the analyses confirmed that the sintered magnets of examples 1 and 2 and comparative examples 1 and 2 comprise a group of crystal particles of Nd—Fe—B based rare earth magnets having a core and a shell covering the core. It was also confirmed that the sintered magnets of examples 1 and 2 and comparative examples 1 and 2 had the mass concentration of Dy in the shell higher than the mass concentration of Dy in the core.

The mass concentrations of Nd and Dy in the core of example 1 were 26.6% by mass and 0.1% by mass, respectively. The mass concentrations of Nd and Dy in the shell of example 1 were 23.3% by mass and 3.7% by mass, respectively.

The mass concentrations of Nd and Dy in the core of example 2 were 26.6% by mass and 0.1% by mass, respectively. The mass concentrations of Nd and Dy in the shell of example 2 were 23.5% by mass and 3.5% by mass, respectively.

The results of the analyses confirmed that the thickest parts of the shell in crystal particles faced grain boundary triple junctions in examples 1 and 2. Namely, it was confirmed that the parts facing grain boundary triple junctions in examples 1 and 2 were thicker than other parts. It was also confirmed that in example 1, as shown in FIG. 4(*a*), a lattice defect 3 was formed between the core and the shell of crystal particles, which may be dislocation. It was also confirmed in example 2 that, as similar to example 1, a lattice defect was formed between the core and the shell of crystal particles.

On the other hand, in comparative example 1, it was confirmed that the thickness of the entire shell was uniform. Namely, it was confirmed that the thickness at the parts facing grain boundary triple junctions in comparative example 1 was the same as that of other parts of the shell. In comparative example 2, it was confirmed that, as shown in FIGS. 7(*a*), 7(*b*) and 7(*c*), no lattice defect was formed between the core and the shell.

[Evaluation of Magnetic Properties]

Rare earth sintered magnets of examples and comparative examples were measured for residual magnetic flux density (Br) and coercive force (HcJ) in a BH tracer.

The sintered magnet of example 1 had residual magnetic flux density of 1.48 T and coercive force of 1345 kA/m.

The sintered magnet of example 2 had residual magnetic flux density of 1.48 T and coercive force of 1329 kA/m.

The sintered magnet of comparative example 1 had residual magnetic flux density of 1.45 T and coercive force of 1313 kA/m.

The sintered magnet of comparative example 2 had residual magnetic flux density of 1.48 T and coercive force of 1266 kA/m.

It was confirmed that examples 1 and 2 were superior in residual magnetic flux density and coercive force compared to comparative example 1. It was confirmed that comparative example 2 had lower coercive force compared to examples 1 and 2.

INDUSTRIAL APPLICABILITY

According to the present invention, a sintered magnet having superior residual magnetic flux density and coercive force, a motor comprising the sintered magnet, an automobile comprising the motor and a method for producing the sintered magnet can be provided.

EXPLANATION OF REFERENCE NUMERALS

1: Grain boundary triple junction; 2: crystal particle; 2*a*: crystal particle of comparative example 1; 3: lattice defect; 4: core of crystal particle; 6: shell; 10: sintered magnet; 20 rotor; 22: rotor core; 24: magnet containing part; 30: stator; 32: coil part; 40: engine; 42: generator; 44: storage battery; 48: wheel; 50: automobile; 100: motor.

The invention claimed is:

1. A sintered magnet comprising a group of R-T-B based rare earth magnet crystal particles, each rare earth magnet crystal particle including a core having a first magnetic material composition comprising a crystal phase and a shell having a second magnetic material composition comprising a crystal phrase, said shell covering the core, wherein a mass ratio of a heavy rare earth element in the shell is higher than a mass ratio of a heavy rare earth element in the core, a thickest part of the shell of neighboring crystal particles are in contact with a grain boundary triple junction, wherein the grain boundary triple junction composition is different from both the first magnetic material composition and the second magnetic material composition, the core crystal phase contains $Nd_2Fe_{14}B$ crystal phase, and the shell crystal phase contains $Dy_2Fe_{14}B$ crystal phase or $Tb_2Fe_{14}B$ crystal phase.

2. A motor comprising the sintered magnet according to claim 1.

3. An automobile comprising the motor according to claim 2.

4. A sintered magnet comprising a group of R-T-B based rare earth magnet crystal particles having a core having a first magnetic material composition comprising a crystal phase and a shell having a second magnetic material composition comprising a crystal phase, said shell covering the core, wherein a mass ratio of a heavy rare earth element in the shell is higher than a mass ratio of a heavy rare earth element in the core, a lattice defect is formed between the core and the shell, the core crystal phase contains $Nd_2Fe_{14}B$ crystal phase, and the shell crystal phase contains $Dy_2Fe_{14}B$ crystal phase or $Tb_2Fe_{14}B$ crystal phase.

5. The sintered magnet according to claim 1, wherein the R-T-B based rare earth magnet contains $R_2T_{14}B$, where R is at least one rare earth element selected from the group consisting of La, Ce, Pr, Nd, Pm, Sm, Eu, Gd, Tb, Dy, Ho, Er, Tm, Yb, and Lu, and where T is a transition metal element of Fe or Co.

6. The sintered magnet according to claim 1, wherein a difference in mass concentrations of the heavy rare earth element between the core and the shell is 1% to 10% by mass.

7. The sintered magnet according to claim 1, wherein a mass concentration of a light earth element in the core is 17% to 27% by mass.

8. The sintered magnet according to claim 1, wherein a mass concentration of the heavy rare earth element in the core is 0% to 10% by mass.

9. The sintered magnet according to claim 1, wherein a mass concentration of the heavy rare earth element in the shell is 1% to 15% by mass.

10. The sintered magnet according to claim 1, wherein a mass concentration of the element T in the core or the shell is 65% to 75% by mass.

11. The sintered magnet according to claim 1, wherein a mass concentration of the element B in the core or the shell is 0.88% to 2.0% by mass.

12. The sintered magnet according to claim 1, wherein the sintered magnet has a composition of R: 29.0% to 33.0% by mass,
B: 0.85% to 0.98% by mass,
Al: 0.03% to 0.25% by mass,
Cu: 0.01% to 0.15% by mass,
Zr: 0.03% to 0.25% by mass,
Co: 3% by mass or less (excluding 0% by mass),
Ga: 0% to 0.35% by mass,
O: 2500 ppm or less,
C: 500 ppm to 1500 ppm, and
Fe: balance.

13. The sintered magnet according to claim 1, wherein a thickness of the shell facing the grain boundary triple junction is 200 nm to 1000 nm.

14. The sintered magnet according to claim 1, wherein a percentage of the crystal particles in which the thickest part of the shell faces the grain boundary triple junction is 10% by volume or more relative to the sintered magnet as a whole.

15. A method for producing a sintered magnet comprising:

a first step of forming a sintered body by sintering a raw material alloy for an R-T-B based rare earth magnet, wherein the R-T-B based rare earth magnet contains $R_2T_{14}B$ and wherein R comprises Nd;

a second step of attaching, to the sintered body, a heavy rare earth compound containing a heavy rare earth element, wherein the heavy rare earth element comprises Dy or Tb;

a third step of heat-treating at a heat treatment temperature from 500 to 850° C. the sintered body to which the heavy rare earth compound has been attached;

a fourth step of heat-treating at a heat treatment temperature from 800 to 1000° C. the sintered body heat-treated in the third step, wherein the heat treatment temperature is a higher temperature than the heat treatment temperature in the third step; and a fifth step of cooling the sintered body heat-treated in the fourth step, at a cooling rate of 20° C./min or more, wherein the resulting sintered magnet is the sintered magnet of claim 1 or claim 4.

16. The sintered magnet according to claim 4, wherein the R-T-B based rare earth magnet contains $R_2T_{14}B$, where R is at least one rare earth element selected from the group consisting of La, Ce, Pr, Nd, Pm, Sm, Eu, Gd, Tb, Dy, Ho, Er, Tm, Yb and Lu, and where T is a transition metal element of Fe or Co.

17. The sintered magnet according to claim 4, wherein a difference in mass concentrations of the heavy rare earth element between the core and the shell is 1% to 10% by mass.

18. The sintered magnet according to claim 4, wherein a mass concentration of a light rare earth element in the core is 17% to 27% by mass.

19. The sintered magnet according to claim 4, wherein a mass concentration of the heavy rare earth element in the core is 0% to 10% by mass.

20. The sintered magnet according to claim 4, wherein a mass concentration of the heavy rare earth element in the shell is 1% to 15% by mass.

21. The sintered magnet according to claim 4, wherein a mass concentration of the element T in the core or the shell is 65% to 75% by mass.

22. The sintered magnet according to claim 4, wherein a mass concentration of the element B in the core or the shell is 0.88% to 2.0% by mass.

23. The sintered magnet according to claim 4, wherein the sintered magnet has a composition of R: 29.0% to 33.0% by mass,
B: 0.85% to 0.98% by mass,
Al: 0.03% to 0.25% by mass,
Cu: 0.01% to 0.15% by mass,
Zr: 0.03% to 0.25% by mass,
Co: 3% by mass or less (excluding 0% by mass),
Ga: 0% to 0.35% by mass,
O: 2500 ppm or less,
C: 500 ppm to 1500 ppm, and
Fe: balance.

24. The sintered magnet according to claim 4, wherein a percentage of the crystal particles in which a lattice defect is formed between the core and the shell is 10% by volume or more relative to the sintered magnet as a whole.

25. A motor comprising the sintered magnet according to claim 4.

26. An automobile comprising the motor according to claim 25.

* * * * *